US006253669B1

(12) United States Patent
Bourque

(10) Patent No.: US 6,253,669 B1
(45) Date of Patent: Jul. 3, 2001

(54) HOST DISPENSER

(76) Inventor: Michael P. Bourque, 502 Holly Ave., Manchester, NH (US) 03103

( * ) Notice: Subject to any disclaimer, the term of this patent is extended or adjusted under 35 U.S.C. 154(b) by 0 days.

(21) Appl. No.: 09/288,472

(22) Filed: Apr. 8, 1999

Related U.S. Application Data

(60) Provisional application No. 60/120,834, filed on Feb. 19, 1999.

(51) Int. Cl.[7] ..... B65H 3/00

(52) U.S. Cl. ..... 99/534; 99/448; 99/484; 221/199; 221/255; 221/270; 221/274

(58) Field of Search ..... 99/448, 484, 516, 99/534, 535, 536; 221/199, 255, 270, 271, 272, 274; 222/192, 631, 500

(56) References Cited

U.S. PATENT DOCUMENTS 2,211,799 * 8/1940 Tatter ..... 221/270
3,193,139 * 7/1965 Iannone et al. ..... 221/255
3,326,413 * 6/1967 Anderson ..... 221/255
5,131,565 * 7/1992 Lilly ..... 221/270

* cited by examiner

*Primary Examiner*—Reginald L. Alexander
(74) *Attorney, Agent, or Firm*—Bourque & Associates, P.A.

(57) ABSTRACT

The disclosed invention provides a Host dispenser, which substantially eliminates the possibility of spreading unwanted germs amongst the members of a church congregation. The disclosed apparatus allows a single Host to be dispensed to a person. The Host dispenser includes a Host magazine in which a plurality of individual Hosts are stored. The Host magazine is configured to register or index the plurality of Hosts, one at a time to an ejection position, where a manually operated ejection ram ejects one Host at a time out of a dispensing opening or port included in the Host dispenser. The Host dispenser further includes a sacramental wine reservoir and dispensing valve for selectively dispensing a small amount of sacramental wine onto a Host as it is dispensed from the Host dispenser.

7 Claims, 11 Drawing Sheets

HOST DISPENSER

RELATED APPLICATIONS

This application is related to and claims priority from U.S. Provisional Patent Application Ser. No. 60/120,834, filed Feb. 19, 1999, the disclosure of which is fully incorporated herein by reference.

FIELD OF THE INVENTION

This invention relates to an apparatus for dispensing Hosts or communion wafers and sacramental wine during a liturgical service. In particular, the disclosed invention provides a Host dispenser, which eliminates a need to have a priest or Eucharist minister physically handle a Host as it is being dispensed to a member of the congregation.

BACKGROUND OF THE INVENTION

During many liturgical services, such as a Catholic Mass and in particular, during the communion right, Hosts are dispensed to members of the congregation. Typically, Hosts are provided in the form of thin, substantially circular wafers, which are dispensed by priests and/or Eucharist ministers, who physically pick up each individual Host and offer it to a member of the congregation. While Hosts are generally transferred from the hand of the priest or Eucharist minister into the hand of a member of the congregation, they may also be placed directly onto the tongue of a member of the congregation. These acts provide the opportunity to expose the Host to unwanted germs, which may be transferred to members of a church congregation. The potential for the spread of germs has resulted in many members of a congregation refusing to accept communion.

Accordingly, what is needed is a more sanitary apparatus for dispensing Hosts to the members of a church congregation that would eliminate or substantially reduce the potential for the spread of germs and the like between members of the congregation.

SUMMARY OF THE INVENTION

The disclosed invention provides a Host dispenser, which substantially eliminates the possibility of spreading unwanted germs amongst the members of a church congregation. The disclosed apparatus allows a single Host to be dispensed to a person. The Host dispenser includes a Host magazine in which a plurality of individual Hosts are stored.

The Host magazine is configured to register or index the plurality of Hosts, one at a time to an ejection position, where a manually operated ejection ram dispenses one Host at a time out of a dispensing opening in the dispenser. The Host dispenser further includes a reservoir and dispenser for selectively dispensing a small amount of sacramental wine onto a Host as it is dispensed from the Host dispenser.

DESCRIPTION OF THE DRAWINGS

These and other features of the present invention will be explained in conjunction with the drawings, wherein.

DETAILED DESCRIPTION OF THE INVENTION

Figure 1:
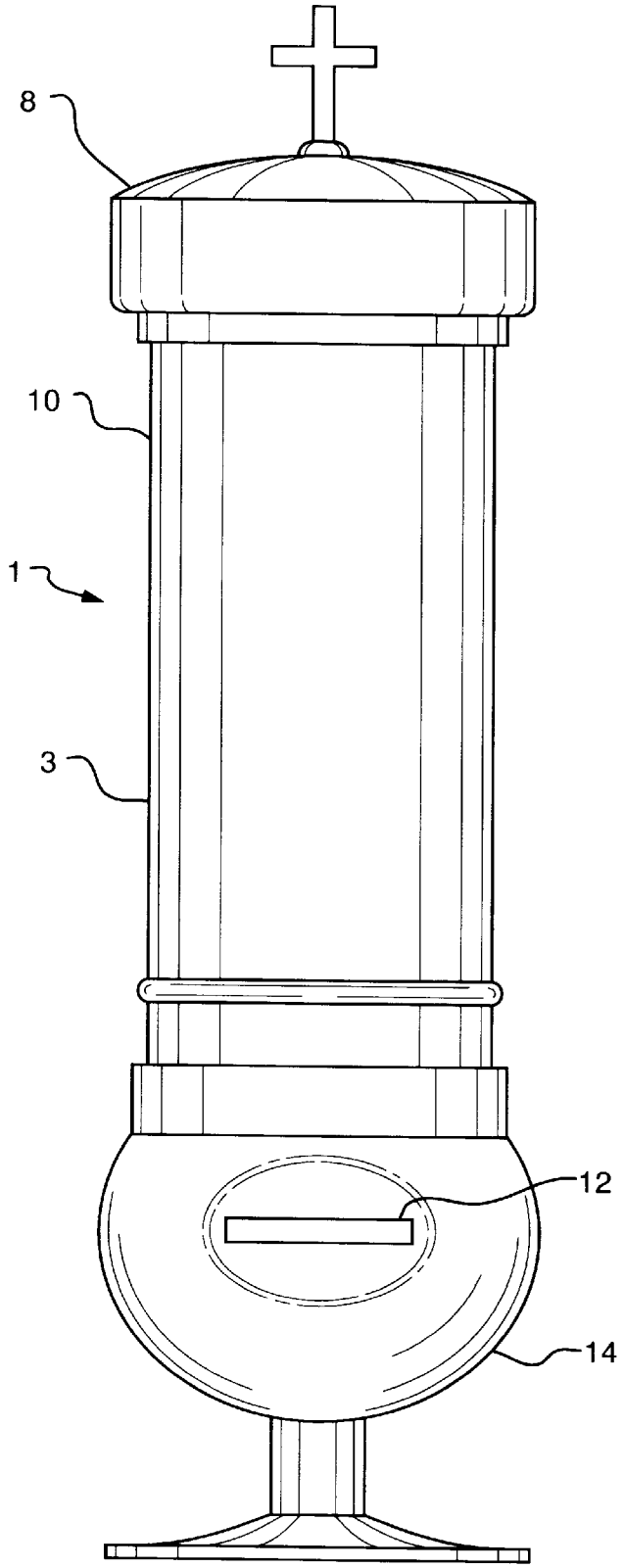
FIG. 1 is a front view of a Host dispenser according to one embodiment of the invention.
Figure 2:
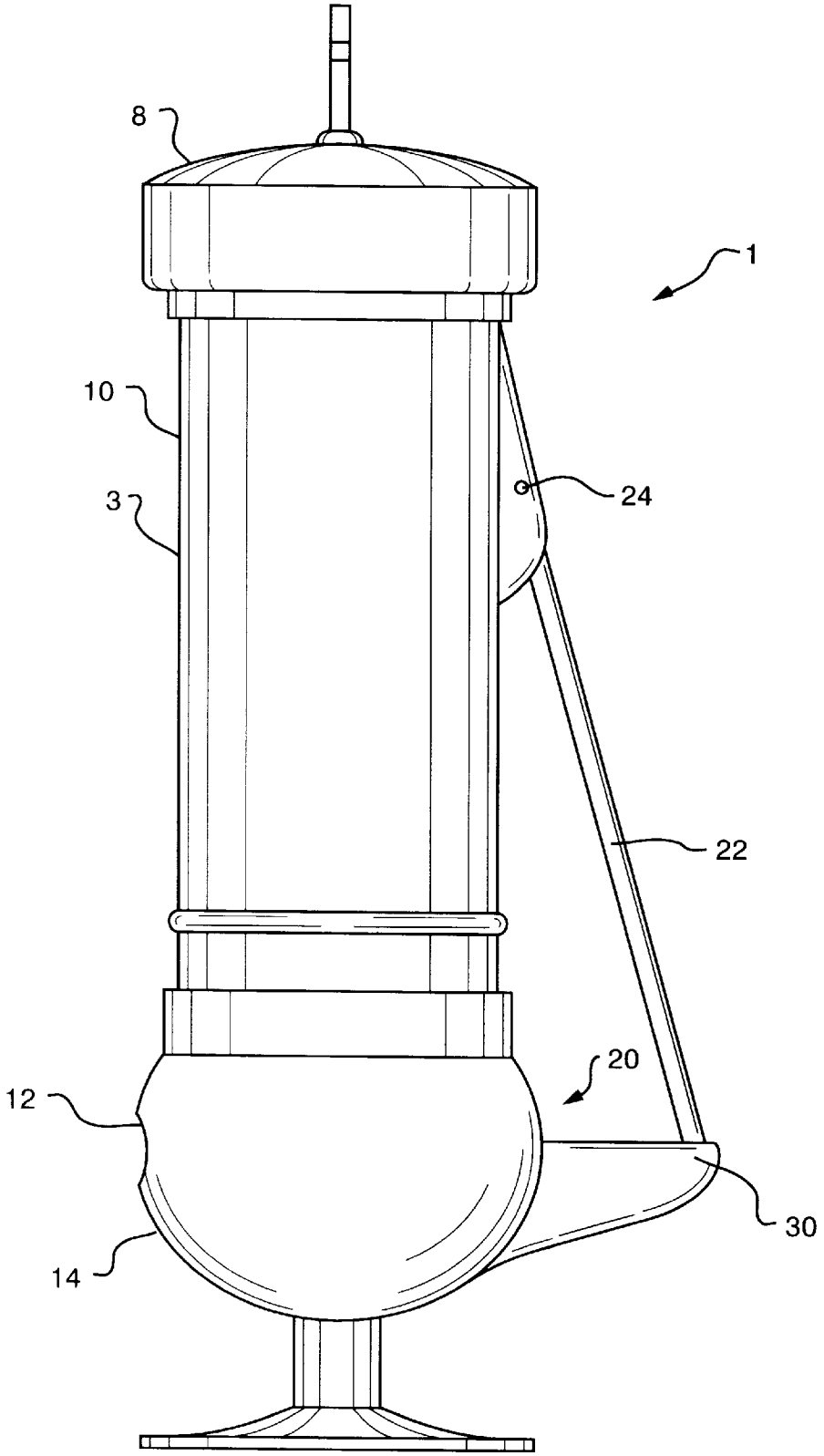
FIG. 2 is a side view of the Host dispenser of FIG. 1.
Figure 3:
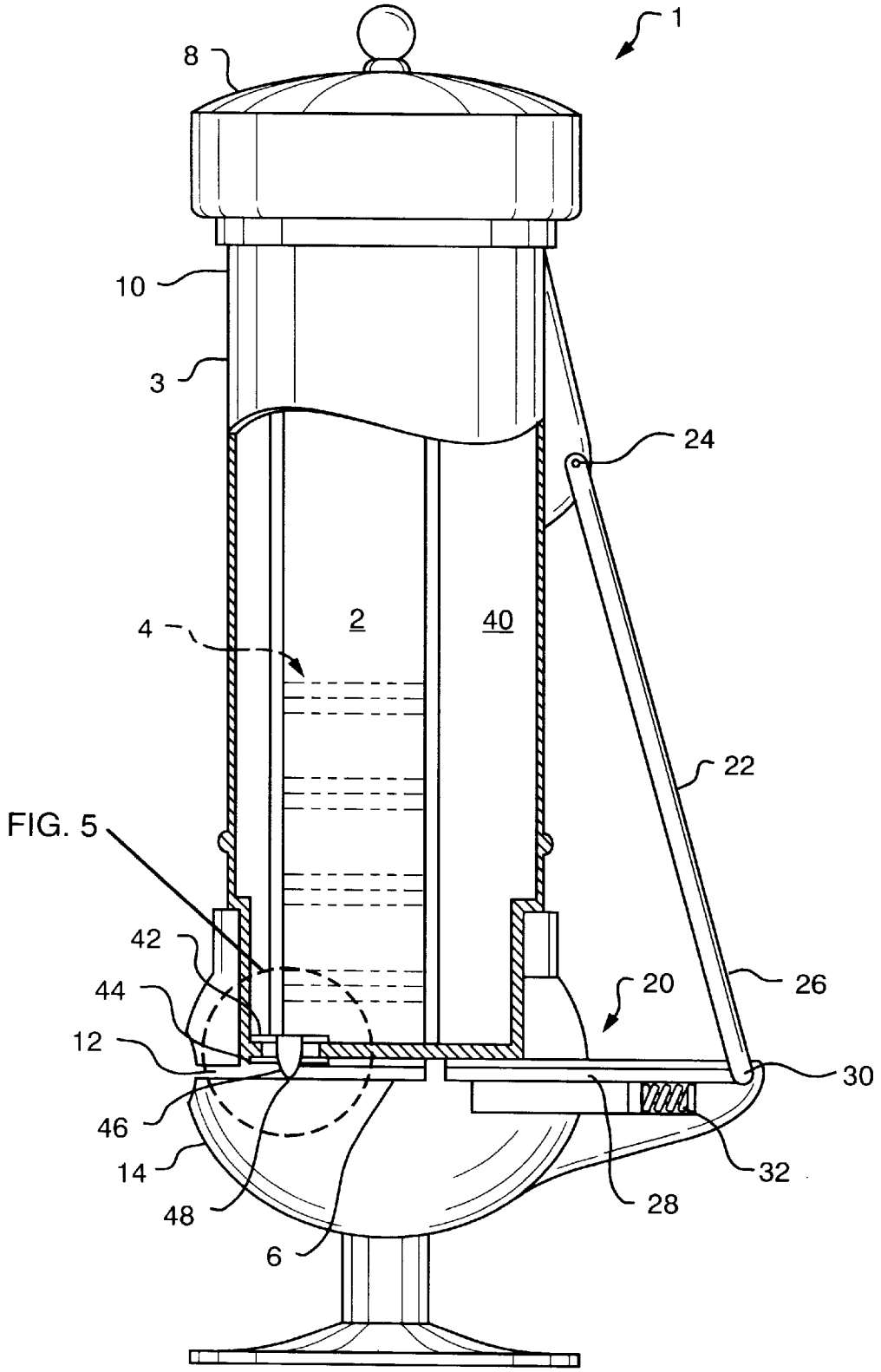
FIG. 3 is a partially cut-away side view of the Host dispenser of FIGS. 1 and 2.

Turning now to the figures and, in particular, FIGS. 1–5, a Host dispenser 1, according to a first embodiment of the disclosed invention is shown. The Host dispenser 1 includes a Host magazine 2, in which a plurality of Hosts 4 are stored for eventual dispensing to the members of a church congregation. As is well known to those skilled in the art, the Hosts 4 are typically provided as thin, substantially circular wafers of unleavened bread. Of course, the diameter of the Hosts 4 may vary. Accordingly, it is envisioned that Host dispensers with different size Host magazines 2, or even Host magazine inserts 2 or the like may be provided to accommodate different sized Hosts.

In the embodiments shown in the figures, the Hosts 4 are indexed or registered within the Host magazine 2 towards an ejection position 6. The motive force for indexing the Hosts is gravity. As each Host in the stack of Hosts is dispensed, gravity simply acts upon the remaining Hosts with the magazine and allows the stack to drop to the bottom of the magazine so that, as long as at least one Host 4 remains in Host magazine 2, a Host is available at the ejection position 6.

Although the embodiments shown in the figures utilize gravity to register the Hosts to the ejection position 6, it is envisioned that springs or the like may be utilized to index the Hosts within the magazine 2. This would be especially in an embodiment where the Host ejection position 6 is not at the bottom of the Host magazine 2 but, rather, at the top of the magazine.

In the embodiment shown, the Host dispenser 1 includes a cap 8, which can threadingly or otherwise engage a top end 10 of an outer housing 3 of the Host dispenser 1. In this manner, the top cap 8 can be readily removed from the Host dispenser 1 in order to allow the Host magazine to be filled.

The Host dispenser 1 includes a Host dispensing mechanism 20, which partially ejects one Host 4 at a time from the ejection position 6 through a Host dispensing port 12. In the embodiment shown, the Host dispensing port 12 is located towards a base end 14 of the Host dispenser 1.

Preferably, the Hosts 4 are partially ejected out of the Host dispensing port 12 a sufficient distance so that they may be fully removed from the Host dispenser 1 by the individual receiving the Host. This will reduce not only the spread of germs, but will also reduce the possibility that Hosts will fall out of the dispenser if the individual receiving the Host is not immediately available to accept the Host.

The Host dispensing mechanism 20 includes a spring loaded trigger handle 22 which is pivotally attached to the Host dispenser outer housing 3 towards the top end of the Host dispenser 1 at a first pivot point 24. A Host ejection ram 28 is attached to the opposite end 26 of the trigger handle 22. This attachment is also a pivotal attachment, using a second pivot point 30.

A trigger handle spring 32 biases the ejection ram 28 towards the back side of the Host magazine 2 when the trigger handle 22 is in the normal, at rest position. Accordingly, when the trigger handle 22 is in the normal position, gravity acts upon the Hosts 4 in the Host magazine 2 so as to index the stack of Hosts toward the bottom of the Host dispenser 1 so that a Host 4 is present in the Host ejection position 6. When the trigger handle 22 is operated, the Host ejection ram 28 moves in the direction of the Host dispensing port 12, carrying the Hosts located in the ejection position 6 partially out of the dispensing port 12.

The Host ejection ram 28 may take any one of the number of forms, including a push ram, which pushes the Host in the ejection position out through the dispensing port or a grasping-type ram which uses frictional engagement between the ejection ram and the Host being dispensed to move the Host out of the dispensing port. Of course, the movement of the ejection ram 28 is limited to permit only partial ejection of a Host out of the dispensing port 12 as indicated above.

When the ejection trigger handle 22 is released, the trigger handle spring 32 returns the Host ejection ram 28 back to its normal, at rest position thus allowing another Host 4 to be indexed under the influence of gravity, to the Host ejection position 6.

Figure 4:
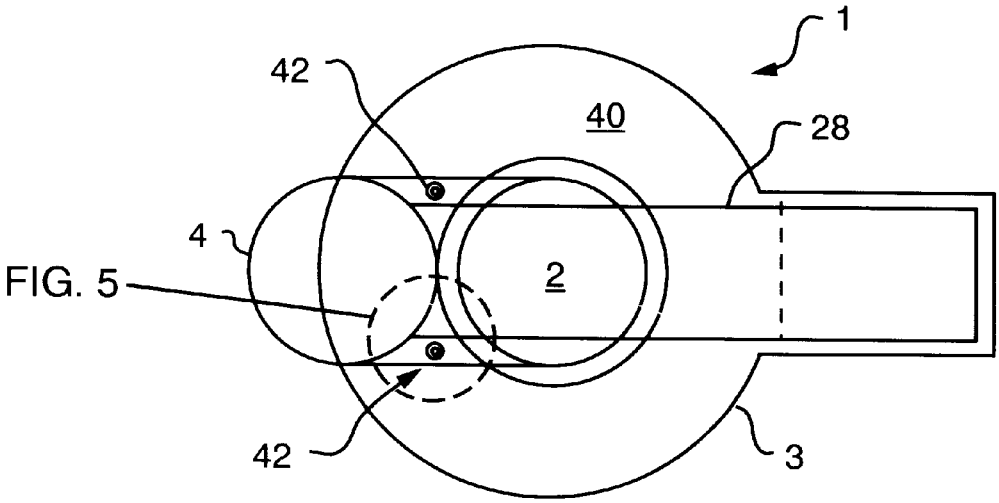
FIG. 4 is a sectional top view of the Host dispenser of FIG. 1.
Figure 5:
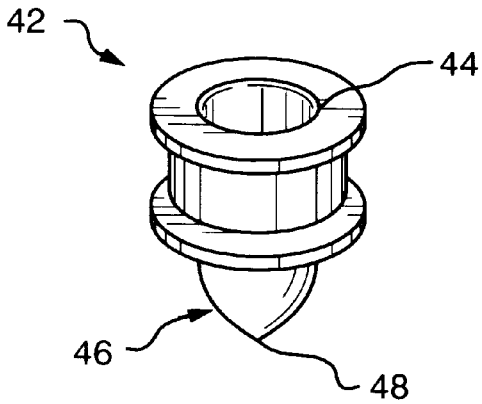
FIG. 5 is a perspective view of sacramental wine dispenser included in the Host dispenser of FIG. 1.
Figure 6:
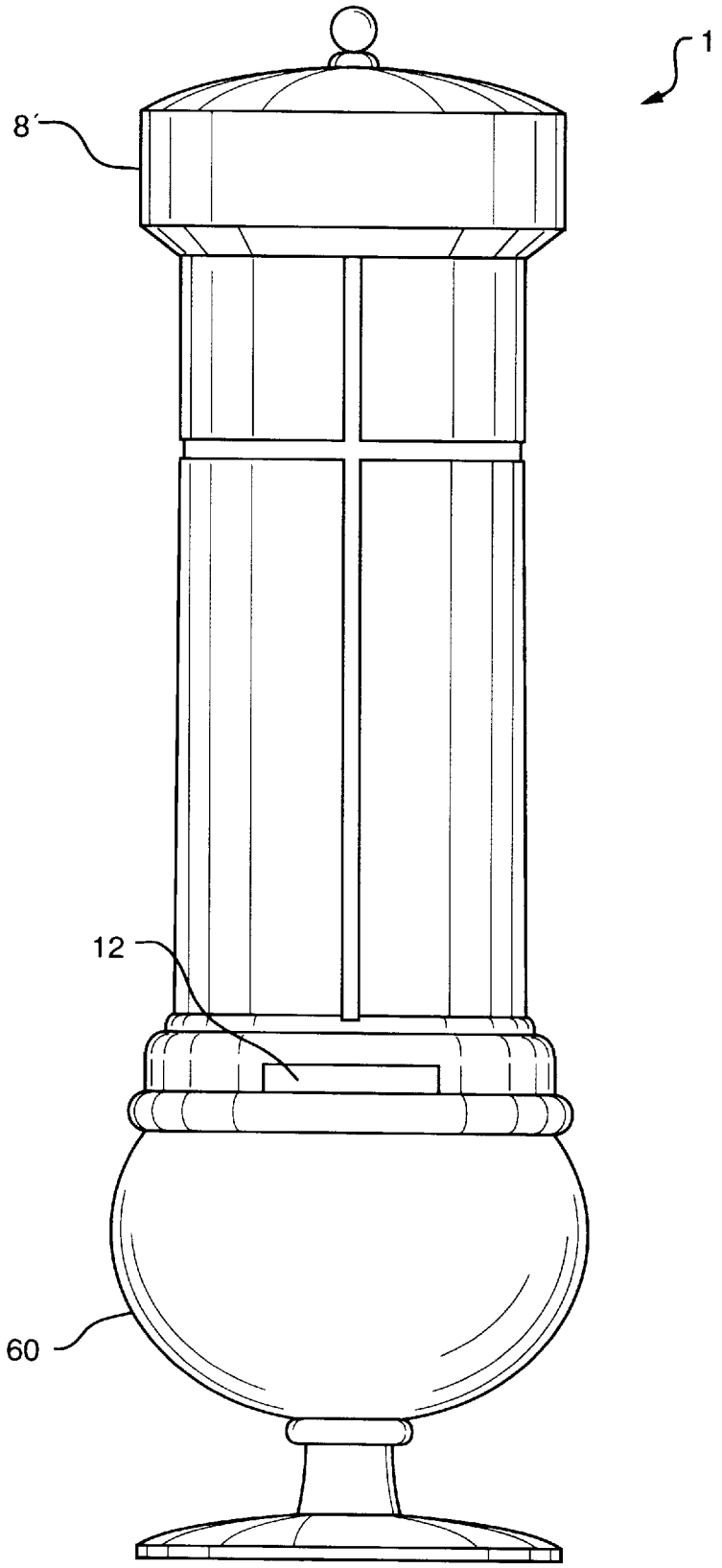
FIG. 6 is a front view of a Host dispenser according to a second embodiment of the invention.
Figure 7:
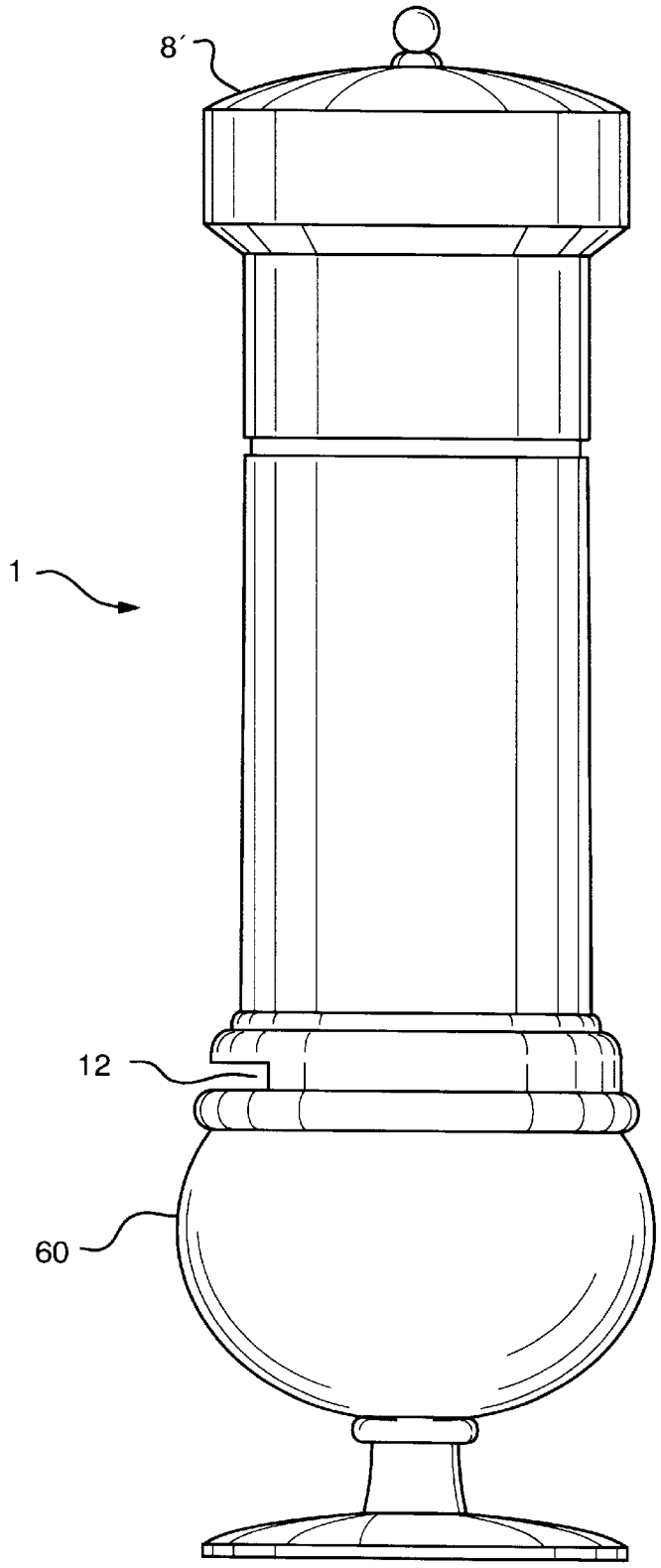
FIG. 7 is a side view of the Host dispenser of FIG. 6.
Figure 8:
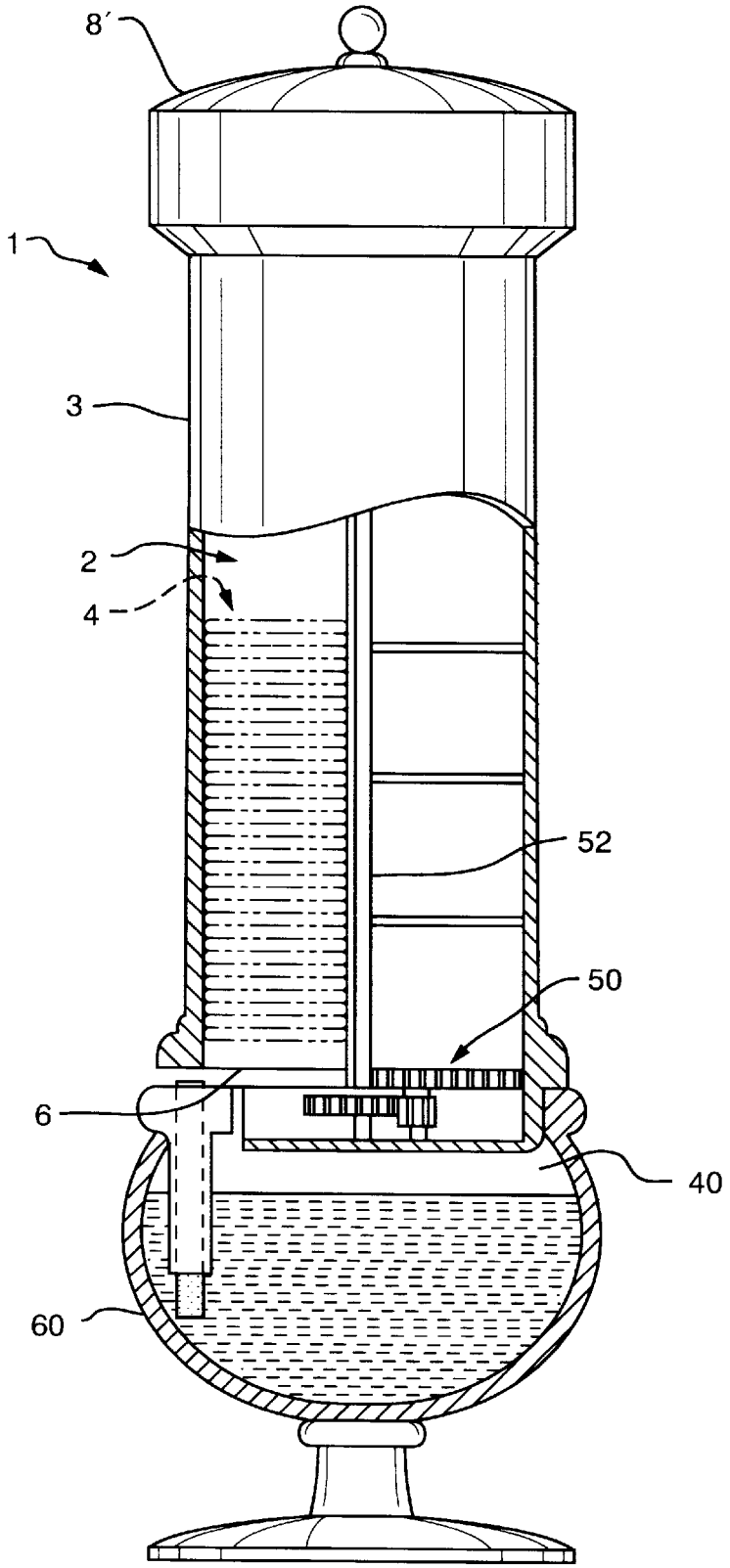
FIG. 8 is a partially cut-away side view of the Host dispenser of FIGS. 6 and 7.
Figure 9:
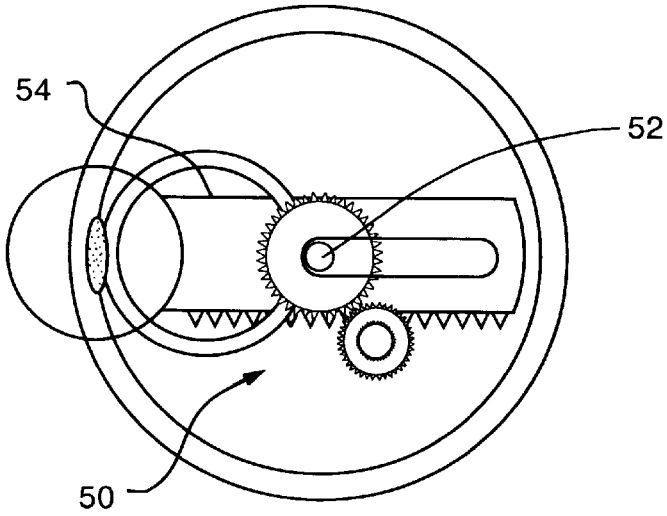
FIG. 9 is a sectional top view of the Host dispenser of FIG. 6.
Figure 10:
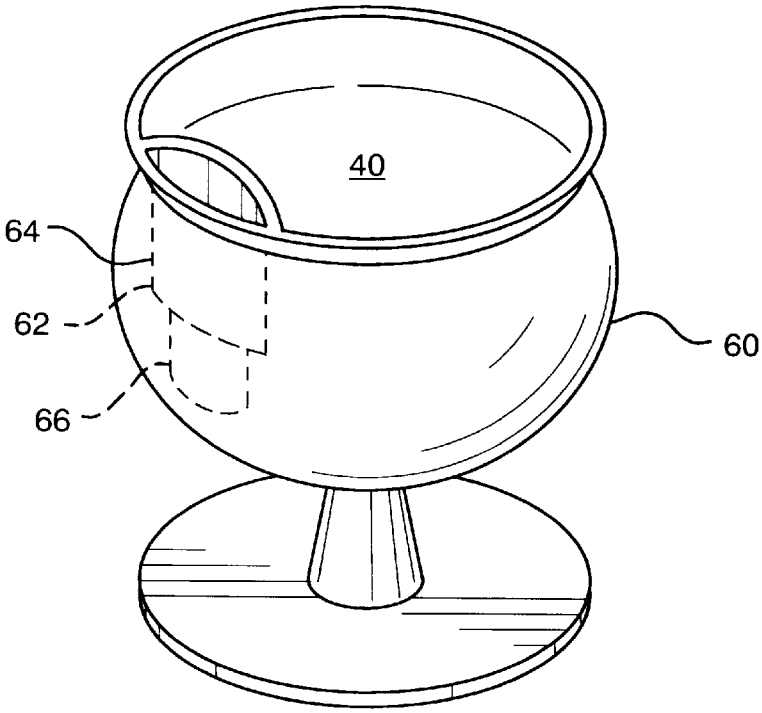
FIG. 10 is a perspective view of sacramental wine reservoir and dispenser included in the Host dispenser of FIG. 6.
Figure 12:
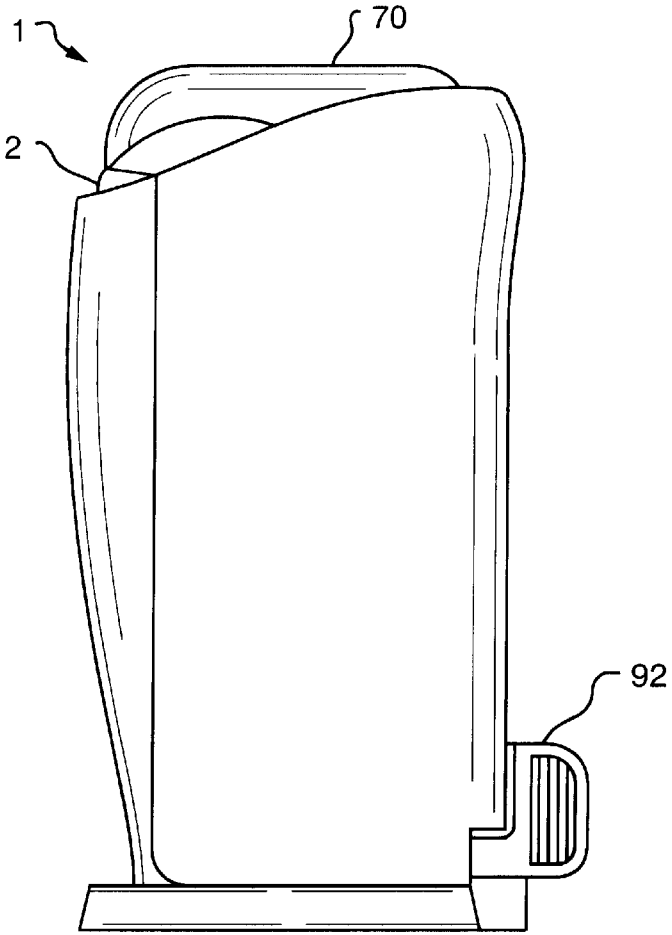
FIG. 12 is a side view of the Host dispenser of FIG. 11.
Figure 11:
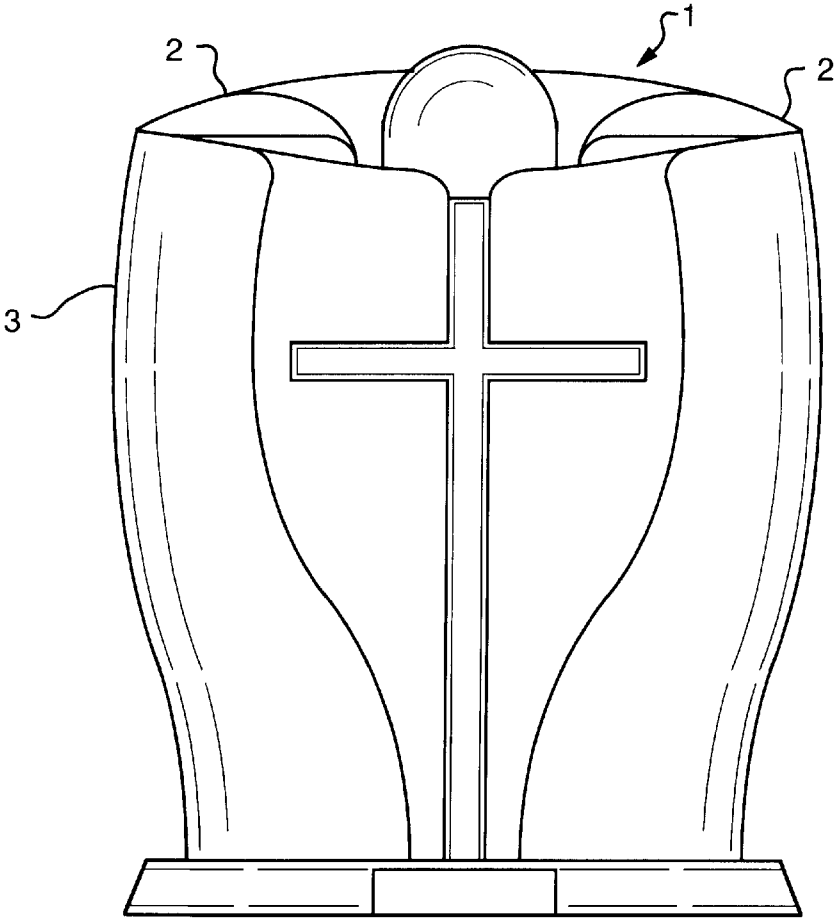
FIG. 11 is a front view of a Host dispenser according to a third embodiment of the invention.
Figure 13:
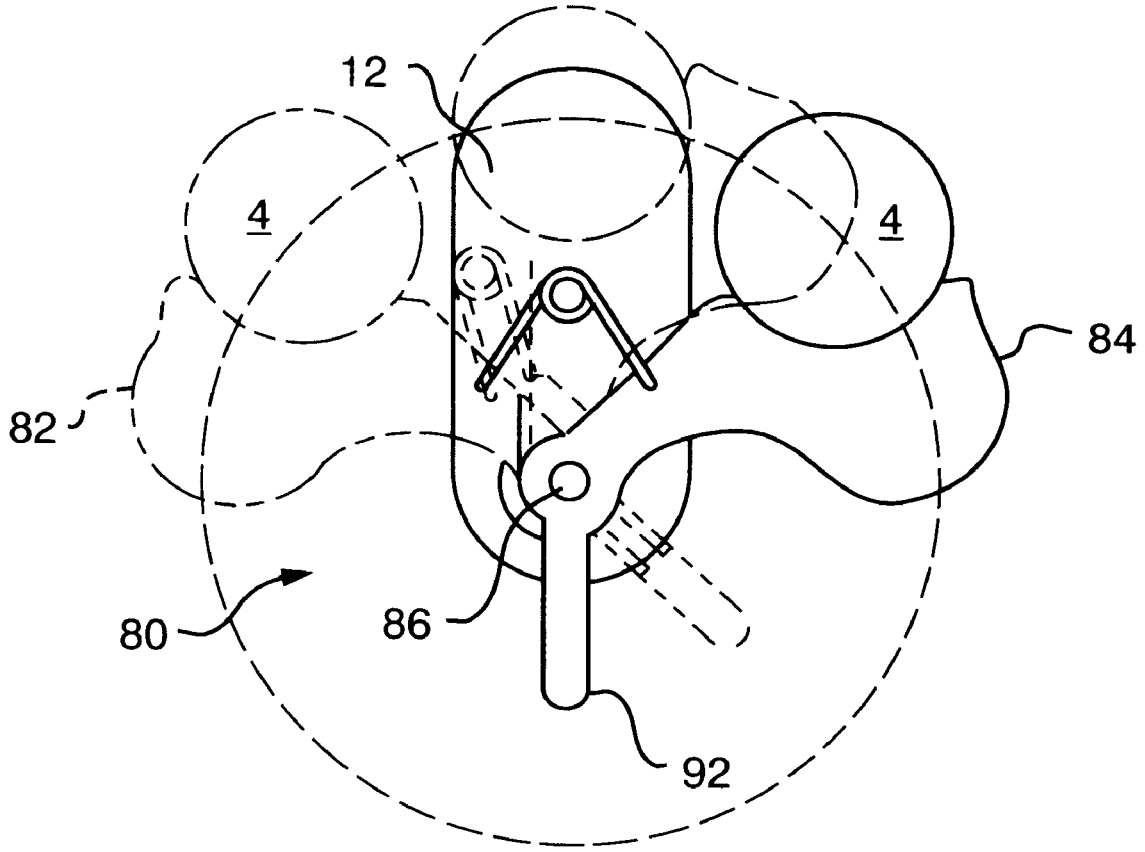
FIG. 13 is an exploded perspective view of the Host dispenser of FIGS. 11 and 12.
Figure 14:
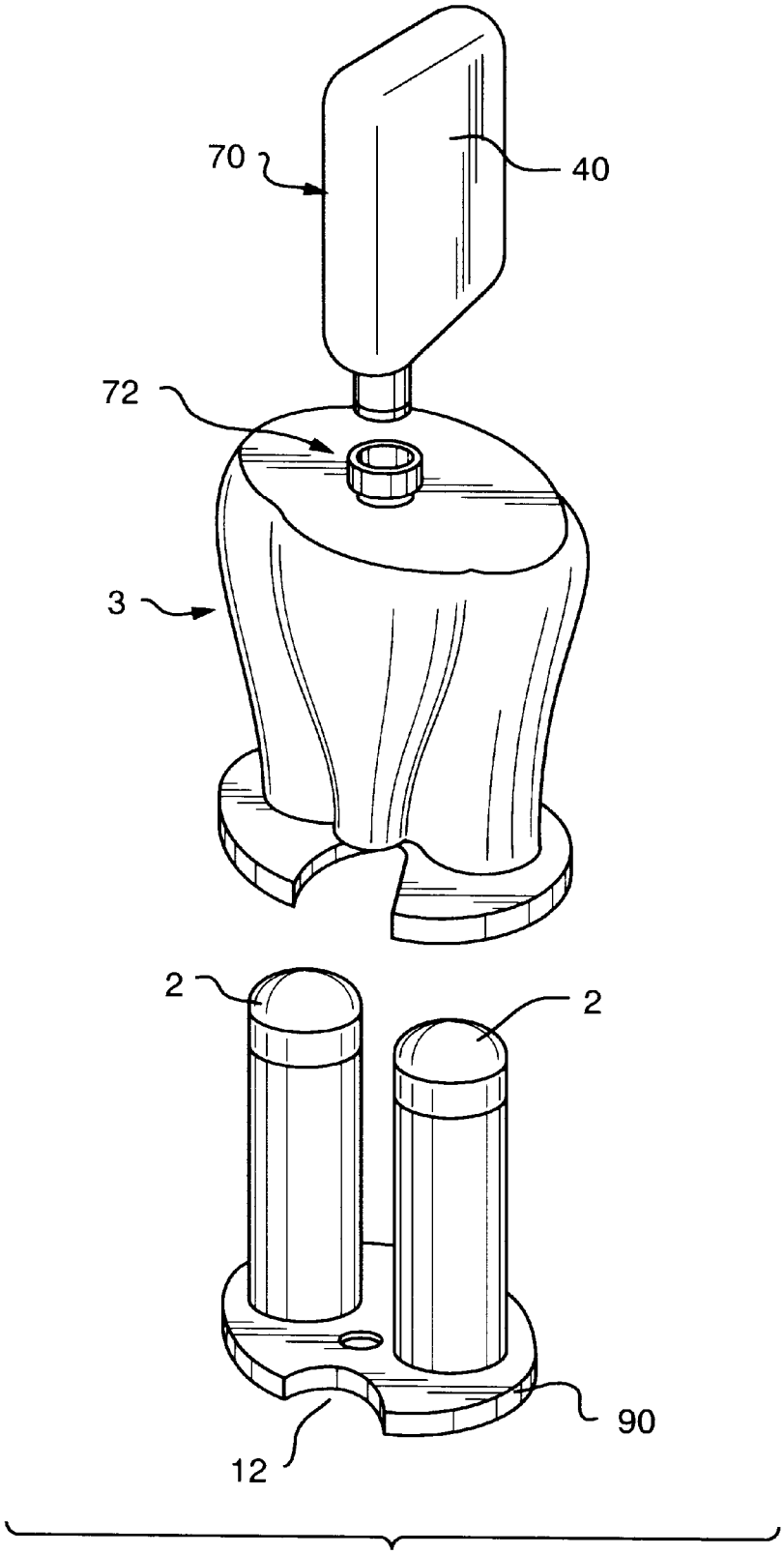
FIG. 14 is a sectional top view of the Host dispenser of FIG. 11.

Surrounding the Host magazine 2, within the outer housing 3, is a sacramental wine reservoir 40, wherein a quantity of sacramental wine is stored for dispensing onto each Host 4 as it is ejected from the Host dispenser 1. The sacramental wine reservoir 40 communicates with the Host ejection position 6 via a dispensing valve 42, which is preferably a wet-tip paint-type valve assembly. The valve assembly 42 includes a removable grommet 44 which seals the opening that joins the sacramental wine reservoir 40 with the Host ejection position 6. Through the center of the grommet 44 is a paint-type applicator 46, which is selected to retain the sacramental wine within the sacramental wine reservoir 40 while, at the same time, allowing a wet tip 48, which extends into the Host ejection position to "paint" a controlled amount of sacramental wine upon each Host 4 as it is pushed from the ejection position 6 by the Host ejection ram 28 and out the dispensing port 12. In the preferred embodiment, the wet tip paint dispenser includes a foam-type painter housed within a rubber grommet, which can be readily removed from the Host dispenser 1 and be replaced with a new assembly 42 in order to satisfy cleanliness requirements. As shown in FIG. 4, the Host dispenser 1 may include multiple sacramental wine dispensing valves 42.

In operation, the Host dispenser of FIGS. 1 through 5 works as follows. First, the top cap 8 is removed from the Host dispenser 1 to expose the Host magazine 2 and sacramental wine reservoir 40. Then a plurality of Hosts 4 are stacked and inserted into the Host magazine 2. The wine reservoir 40 is also at least partially filled at this time, provided sacramental wine is to be dispensed in connection with the dispensing of Hosts. Of course, the Host dispenser 1 can be utilized without partially filling the sacramental wine reservoir in which case the Host dispenser will be used to simply dispense dry Hosts.

After the Hosts 4 and sacramental wine (if desired) are loaded in to the Host dispenser, the cap 8 is replaced onto the top end 10 of the Host dispenser 1. Then, a Eucharistic minister can dispense Hosts to members of the congregation by operating the dispensing trigger handle 22 as explained above.

A second embodiment of Host dispenser 1 is shown in FIGS. 610. This embodiment also includes a Host magazine 2, within an outer housing 3, in which a plurality of Hosts 4 are stored until they are desired to be dispensed to members of a congregation. While this embodiment has comparable components to the embodiment described above (comparable components are identified in the figures using like reference numbers), a number of the components are either rearranged or replaced with different components to provide this differing embodiment. For example, while the Host dispenser 1 of this second embodiment also includes a top cap 8, the top cap 8 is a twisting cap, which drives a gear mechanism 50 through a drive shaft 52 to move a gear driven Host ejection ram 54. Thus, in operation, a Eucharistic minister would twist the top cap 8 of the Host dispenser 1 is order to partially eject a Host 4 from the ejection position 6 and out of the Host dispensing port 12.

An additional difference between this embodiment and the embodiment discussed above is the sacramental wine reservoir 40. In the second embodiment, the sacramental wine reservoir 40 is formed by the interior of a chalice 60, which serves as the base of the Host dispenser 1. Since, in this embodiment, the sacramental wine in located below the stack of Hosts 4 within the Host magazine 2, the sacramental wine must be "wicked" up so that it can be applied to a Host 4 as it is dispensed form the Host dispenser 1. This can be accomplished by using a sacramental wine wick 62 which, like the wet-tip paint-type applicator described above, may comprise a disposable foam/rubber dispensing valve assembly. Again, like the assembly discussed earlier, the wick-type assembly 62 preferably comprises a rubber grommet 64 through which a foam or other wick 66 passes. Provided a suitable wick material is utilized, the lower end of the wick 66 is immersed in the sacramental wine provided in the wine reservoir 40, and the upper end of the wick 66 communicates with a Host 4 as it is dispensed from the Host dispenser 1 through the dispensing opening 12, then a suitable amount of sacramental wine can be applied to each Host as it is dispensed. Of course, as with the embodiment of FIGS. 1–5, this embodiment can also be utilized without sacramental wine in order to dispense dry Hosts to the congregation.

It is contemplated that the various features described with respect to either of the above-mention embodiments or, the subsequently described embodiments for that matter, can be interchanged. For example, Host dispensing mechanism 20 of the embodiment of FIGS. 1–5 may be utilized in conjunction with the base assembly sacramental wine chalice 60 of the embodiment of FIGS. 6–10.

A third embodiment of a Host dispenser 1 is shown in FIGS. 11 through 14. In this embodiment, multiple Host magazines 2 may be provided within the outer housing 3. Also housed within the outer housing 3 may be a wine reservoir 40, which, may be provided as an inverted container 70 having a base end dispensing mechanism 72 included thereon. The base end dispensing valve 72 may be similar to the wet-tip paint-type application described with respect to the first described embodiment of the invention.

In this embodiment, a swing-arm mechanism 80 (FIG. 13) would be utilized in order to alternately dispense Hosts 4 from the multiple Host magazine 2. The swing-arm mechanism 80 includes at least one and, preferably two swing arms 82 and 84 pivotally attached at a pivot point 86. The base of the Host dispenser 90 is configured to allow the swing arms to be manipulated between two extreme positions using a simple lever 92 which would be operated by the Eucharistic minister. As the lever 92 is positioned, Hosts 4 will be alternately grasped by swing arms 82 and 84 from each Host magazine 2 and propelled through the Host dispenser base 90 to the Host dispensing port 12. As with the embodiments described above, this embodiment would also only partially eject the Host from the Host dispenser 1.

Accordingly, the disclosed invention provides a Host dispenser, which substantially eliminates the possibility of spreading unwanted germs amongst the members of a church congregation. The disclosed apparatus allows a single Host to be dispensed to a person. Each Host that is dispensed may also include a small amount of sacramental wine, which is dispensed from a sacramental wine reservoir onto each Host as it is dispensed from the Host dispenser.

Modifications and Substitutions by one of ordinary skill in the art are considered to be within the scope of the present invention, which is not to be limited accept by the claims which follow.

What is claimed is:

1. A Host dispenser comprising:

at least one Host magazine for holding a plurality of Hosts in a stacked fashion therein, said Hosts being indexed to a Host ejection position;

a Host ejection mechanism for partially ejecting a Host from said Host ejection position out of said Host dispenser through a Host dispensing opening;

a sacramental wine reservoir for holding an amount of sacramental wine within said Host dispenser; and a sacramental wine dispensing valve for dispensing sacramental wine onto each Host as it is dispensed from said Host dispenser.

2. The Host dispenser of claim 1 wherein said sacramental wine dispensing valve comprises a wet-tip paint-type applicator.

3. The Host dispenser of claim 1 wherein the sacramental wine dispensing valve is a wick-type dispensing valve for wicking sacramental wine from a sacramental wine reservoir located below said Host magazine.

4. The Host dispenser of claim 1, wherein said sacramental wine dispensing valve is disposable.

5. The Host dispenser of claim 1, wherein said sacramental wine reservoir comprises a chalice located at a base end of said Host dispenser, said chalice including said sacramental wine reservoir and communicating with said Host ejection position using a wick-type sacramental wine dispensing valve.

6. A Host dispenser comprising at least one Host magazine for holding a plurality of Hosts in a stacked fashion therein, said Hosts being indexed to a Host ejection position; and a Host ejection mechanism for partially ejecting a Host from said Host ejection position out of said Host dispenser through a Host dispensing opening, wherein said Host dispensing mechanism comprises a rotational cap communicating with a gear-driven host ejection ram via a drive shaft.

7. The Host dispenser of claim 6, wherein said at least one Host magazine includes at least two Host magazines and wherein said at least one swing arm includes at least two swing arms for alternately dispensing Hosts from said at least two Host magazines.

* * * * *